United States Patent [19]

Hofer et al.

[11] 4,180,040

[45] Dec. 25, 1979

[54] REGULATOR FOR A FUEL INJECTION PUMP

[75] Inventors: Gerald Höfer, Weissach-Flacht; Karl Konrath, Ludwigsburg; Manfred Schwarz, Gerlingen; Helmut Laufer, Stuttgart, all of Fed. Rep. of Germany

[73] Assignee: Robert Bosch GmbH, Stuttgart, Fed. Rep. of Germany

[21] Appl. No.: 779,885

[22] Filed: Mar. 21, 1977

[30] Foreign Application Priority Data

Mar. 26, 1976 [DE] Fed. Rep. of Germany ..... 2612940

[51] Int. Cl.[2] ..... F02D 1/06; F02M 39/00; F04B 49/00

[52] U.S. Cl. ..... 123/140 R; 123/140 J; 123/139 BD; 417/294

[58] Field of Search ..... 123/139 BD, 139 AD, 123/139 AF, 139 AA, 139 AC, 140 R, 140 A, 140 FG, 140 MC, 140 J, 112

[56] References Cited

U.S. PATENT DOCUMENTS

| | | | |
|---|---|---|---|
| 3,884,206 | 5/1975 | Ritter | 123/140 J |
| 3,938,488 | 2/1976 | Aoki | 123/140 R |
| 3,942,498 | 3/1976 | Eheim et al. | 123/140 R |
| 3,945,360 | 3/1976 | Laufer | 123/139 BD |
| 3,946,713 | 3/1976 | Laufer | 123/139 BD |
| 3,946,716 | 3/1976 | Konrath | 123/140 R |

FOREIGN PATENT DOCUMENTS

| | | | |
|---|---|---|---|
| 1307994 | 9/1962 | France | 123/140 R |

*Primary Examiner*—Charles J. Myhre
*Assistant Examiner*—P. S. Lall
*Attorney, Agent, or Firm*—Edwin E. Greigg

[57] ABSTRACT

An improved r.p.m. regulator of a fuel injection pump for internal combustion engines includes an improved control spring mechanism. The control spring mechanism is connected to one end of a control lever which in turn is connected at its other end to a fuel supply quantity setting member. The control lever serves to actuate the fuel supply quantity setting member in accordance with the forces applied to the control lever by the control spring mechanism and an r.p.m.-dependent force applying structure which applies a force to the control lever in opposition to the force applied by the control spring mechanism. The control spring mechanism in one embodiment of the invention includes axially aligned tandem springs mounted between the control lever and a setting lever, a first connecting member and a second connecting member. In another embodiment of the invention a single spring is mounted between the control lever and a setting lever and tandem springs are mounted adjacent to one end of the second connecting member in a perforated pot that is associated with the control lever.

11 Claims, 4 Drawing Figures

REGULATOR FOR A FUEL INJECTION PUMP

BACKGROUND OF THE INVENTION

The present invention relates to an r.p.m. regulator of a fuel injection pump for internal combustion engines, and more particularly to an r.p.m. regulator of a fuel injection pump including a pivotably mounted control lever intended to actuate a fuel quantity setting member of the fuel injection pump and engaged by a control spring system including a preloaded control spring disposed between a setting lever and a control lever and acting in opposition to an r.p.m. dependent force in the tensile direction.

Such idle r.p.m. regulators and peak r.p.m. regulators are used for vehicular engines in order to prevent a strong load thrust as the accelerator is depressed. These regulators control only the idle running and the maximal full load revolutions. The revolution region and load region lying in between is controlled directly by means of the accelerator pedal and the regulator mechanism. The regulator spring is pre-stressed and effects a rapid reduction regulation as the maximal full load revolutions magnitude is exceeded.

According to the given injection quantity characteristic determined by the inlet and control cross-sectional areas, a so-called adaptation is desired for some pumps. Such an adaptation is desired when, in the partial load region, that is to say, between the idle running and the full load, the injection quantity increases more with the increasing revolutions than does the actual requirement, which creates unstable regulation regions with jerking vehicular motion and drifting of the engine.

OBJECT AND SUMMARY OF THE INVENTION

It is, therefore, the principal object of the present invention to provide a regulator of the above type which avoids the disadvantages cited.

It is another object of the invention to develop an r.p.m. regulator in which the quantity of fuel injected increases slightly with the revolutions at full load, whereas in the partial load region the quantity of fuel injected remains constant at given revolutions for a given constant accelerator position which decreases slightly with an increase of the revolutions.

This objective is accomplished, according to the present invention, due to the fact that in the above-cited regulator the pressure spring serves as the adapter spring and its excursion is limited by a projection, and the regulator spring is deformed in correspondence to the pre-stressing for the reduction regulation, after the adapter spring has completed its available stroke, terminated by the limiting projection.

The invention will be better understood as well as other objects and advantages thereof will become more apparent from the following detailed description of the invention taken in conjunction with the drawing.

DESCRIPTION OF THE PREFERRED EMBODIMENT

Figure 1:
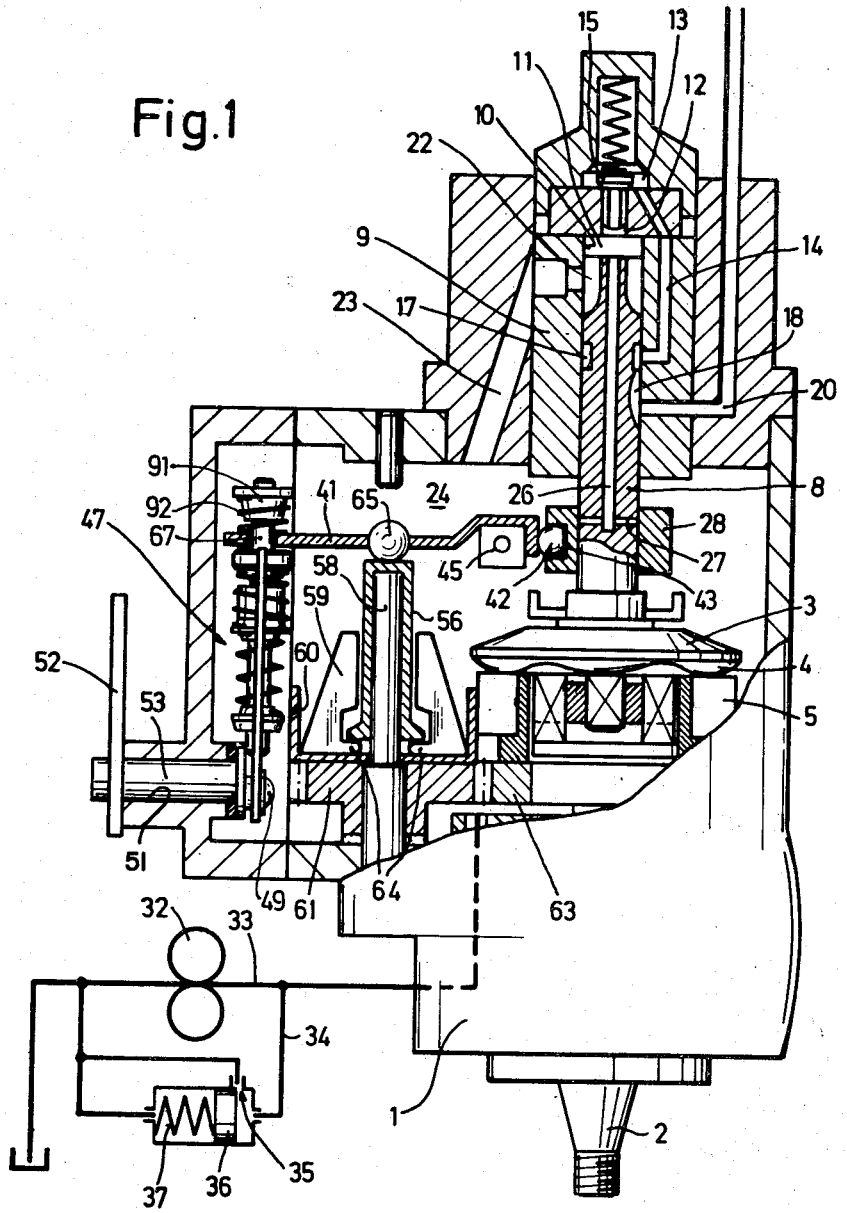
FIG. 1 is a partial section through a fuel injection pump with a single reciprocating and simultaneously rotating pump piston which also serves as a distributor and including the governor mechanism according to the present invention.

The disposition of parts and the method of operation of the regulator according to the present invention is described below using the example of a distribution pump of known construction. A housing 1 of a fuel injection pump for multi-cylinder internal combustion engines contains a drive shaft 2. This drive shaft 2 is coupled to a frontal cam plate 3 which has as many cams 4 as the number of cylinders of the associated internal combustion engine. The cam plate 3 is moved by locally fixed rollers 5 and by the rotation of the drive shaft 2. This motion results in a reciprocating and simultaneously rotating motion of a pump piston 8 coupled with the frontal cam plate 3 and pressed onto the cam plate 3 by a spring (not shown). The pump piston 8 is displaceable within a cylindrical bushing 9 which is closed on top and is inserted into the housing 1. The bushing 9 is provided with a cylinder bore 10 which encloses a working chamber 11. From the working chamber 11, an axial bore 12 communicates with a chamber 13 which, in turn, communicates through a line 14 with the bore 10 of the cylinder bushing 9. The axial bore 12 can be closed by a valve member 15 loaded in the direction of the working chamber 11. The connecting line 14 can be connected in sequence with pressure lines 20 terminating in the bore 10 through an annular groove 17 on the periphery of the pump piston 8 and through an axially oriented distributor groove 18 which is connected thereto. The pressure lines 20 are evenly distributed about the cylinder bore 10 and correspond to the number of cylinders of the internal combustion engine to be supplied with fuel. At each pressure stroke of the pump piston 8, fuel is delivered through the axial bore 12, the chamber 13, the connecting line 14 and the distributor groove 18 to one of the pressure lines 20. During the suction stroke, fuel flows from a suction chamber 24 through a supply line 23 terminating in the bore 10 and through one longitudinal groove 22 of a plurality of such grooves into the working chamber 11. The grooves 22 are equal in number to the number of cylinders of the engine and are similarly configured on the periphery of the pump piston. During the suction stroke of the pump piston 8, the rotation thereof interrupts the connection between the supply line 23 and the longitudinal grooves 22, so that the entire fuel quantity delivered by the pump piston can be supplied to the pressure lines.

For the purpose of regulating the delivered fuel quantity, the working chamber 11 can be connected with the pump suction chamber 24 through an axial blind bore 26 in the pump piston 8 and further through a transverse bore 27 intersecting the blind bore 26. Cooperating with the transverse bore 27 is a fuel quantity setting member 28 in the form of a sleeve slidable on the pump piston 8, where the position of the sleeve determines the point in time at which the upward motion of the pump piston 8 opens the transverse bore 27 and creates a connection between the working chamber 11 and the pump suction chamber 24. From this point on, the pump delivery is interrupted. Thus, the displacement of the sleeve 28 can be used to determine the quantity of fuel which is supplied for injection.

The supply of fuel to the pump working chamber is affected by a fuel pump 32 which aspirates fuel from a supply reservoir through a supply channel 33 into the suction chamber 24. In order to obtain an r.p.m. dependent pressure, a bypass of the fuel pump 32 contains a connecting line 34 with a throttle location 35. The size of the throttle opening can be changed by a piston 36 whose rear face is actuated by a spring 37 and also by the fuel pressure prevailing at the suction side of the pump, and whose front surface is actuated by the fuel pressure prevailing in the supply channel 33.

Figure 2:
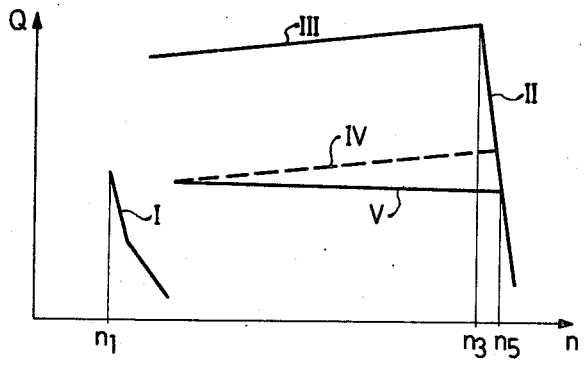
FIG. 2 is an operational graph of the regulator according to the invention.
Figure 3:
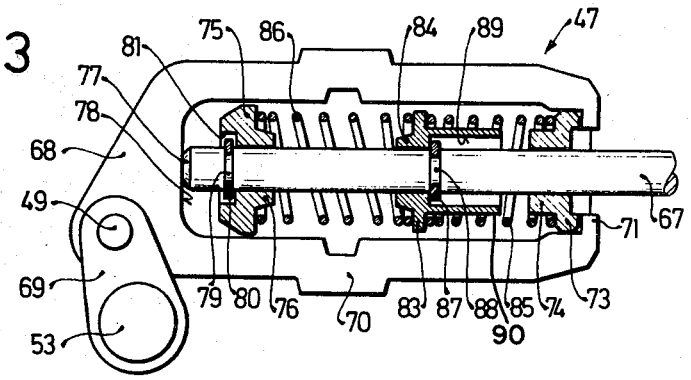
FIG. 3 shows the spring mechanism depicted in FIG. 1 of this invention in an enlarged scale.
Figure 4:
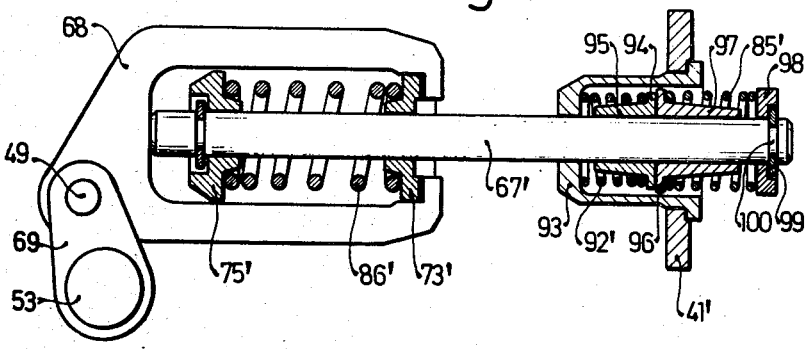
FIG. 4 shows another spring mechanism in an enlarged scale of a second embodiment of this invention.

The change in the injected fuel quantity is effected by setting the sleeve 28 by means of a control lever 41 whose spherical head 42 engages a recess 43 within the sleeve 28. The control lever 41 is mounted on a shaft 45 serving as a fixed pivotal point. The position of this shaft can be changed by means which are not shown, for example, by an eccentric means in order to obtain a basic setting. Fastened to the extreme opposite end of the control lever 41 is a control spring mechanism 47 whose detailed construction is shown in FIGS. 2, 3 and 4. The other end of the control spring mechanism connects via a connecting bolt 49 with a setting lever 69 which is rigidly mounted on an actuating shaft 53. The shaft 53 passes through a sealed bore 51. The shaft 53 can be externally rotated by a further lever 52, fixedly disposed thereon.

Located between the fastening point of the control spring mechanism 47 and the shaft 45 is the point of contact of a centrifugal force governor sleeve 56 which is slidingly displaced by flyweights 59 on a governor shaft 58. The flyweights 59 are located in sheet metal pockets 60 fixedly mounted on a gear 61 carried by the governor axis. The gear 61 is driven by a drive gear 63 rigidly connected with the drive shaft 2, and the flyweights 59 are driven by the sheet metal pockets 60 which, in turn, are driven by the gear 61. The flyweights 50 are moved radially outward corresponding to the r.p.m. and their protruding nose-shaped parts 64 lift the centrifugal force governor sleeve 56. Thus, when the governor sleeve 56 contacts the control lever 41, the r.p.m. dependent centrifugal force is transmitted by lever action to the control lever and against the force of the control spring mechanism 47. In order to keep the distance between the point of contact of the centrifugal force transmitted by the governor sleeve 56 and the shaft 45 constant at all times, this point contains a sphere 65 pressed into the control lever 41.

As soon as the clockwise moment around fixed pivot point 45 provided by the centrifugal force exceeds the counterclockwise moment due to the control spring mechanism 47, the sleeve 28 is moved downwardly in a direction which reduces the fuel injection quantity. This process takes place until an equilibrium of forces again prevails at the control lever 41.

FIG. 2 represents a functional graph of the regulator according to the present invention, wherein the quantity of fuel injected and delivered to the engine is plotted along the ordinate and the r.p.m. are plotted along the abscissa. As previously described, the regulator comprises an idling r.p.m. and peak r.p.m. regulator, i.e., the quantity of injected fuel is rapidly reduced as the idle revolutions or the peak revolutions, respectively are exceeded. In the r.p.m. region lying therebetween, the quantity of fuel injected is arbitrarily variable via the accelerator pedal and the actuating lever 52, along with a regulator-derived influence according to the r.p.m. magnitude n. Whereas the curve I corresponds to the reduction regulation for idling, the curve II corresponds to the reduction regulation for the highest r.p.m. magnitude at a given quantity of fuel injected. Thus the quantity of fuel starts to decrease as the r.p.m. $n_1$ is exceeded during idling, i.e., at idle position of the actuating lever 52, whereby the r.p.m. is again decreased, until a constant idling r.p.m. is attained.

The curve III shows the course of the reduction regulation of the fuel quantity Q at peak revolutions and in which the reduction regulation for lesser apportioned fuel quantities takes place at higher r.p.m. n than for greater apportioned fuel quantities. The apportioned fuel quantity depends, as detailed above, upon the given momentary loading of the engine. If a motor vehicle is traveling uphill, for example, the accelerator is depressed farther, i.e., more fuel is supplied than during operation of the vehicle on level ground. The same applies to vehicular acceleration, for which similarly more fuel is supplied than at constant speed. The curve III represents the behavior of the quantity of fuel with respect to the r.p.m. of the engine when the actuating lever 52 is set to the maximal fuel quantity setting. As apparent herefrom, the fuel quantity increases with an increase in the r.p.m. The reduction regulation then takes place at the r.p.m. magnitude $n_3$, which is the maximal r.p.m. magnitude for this given load condition. This behaviour characteristic of the fuel load quantity is desirable for many internal combustion engines. On the other hand, this behavior characteristic is not desired for lesser apportioned fuel quantities, namely for the partial load region. Since the injected quantity of fuel increase is greater than the actual requirement quantity curve, unstable regulation regions are created which lead to jerkiness in operation of the vehicle as well as spurious drifting of the engine. Hence, in the partial load region, it is not the curve IV, represented by a dashed line and running parallel to the curve III, which is desired, but rather a fuel quantity alteration proportional to the r.p.m. according to the characteristic curve V, wherein the fuel quantity remains constant, respectively decreases slightly, with an increase of the r.p.m. The quantity thereby lies under the actual requirement quantity with an increase of the r.p.m. For each given position of the actuating lever 52 between idling and peak r.p.m., characteristic curves of the fuel versus the r.p.m. are thus generated which run parallel to the curve V, above the curve V with the larger set quantities and below the curve V with the lesser set quantities. This kind of decrease of the fuel quantity with an increase of the r.p.m. is achieved by the fact that the length of the spring mechanism 47 increases in the partial load region with an increase of the r.p.m. so that the sleeve 28 is displaced in the direction of the cam disc and the quantity of fuel injected is consequently decreased. This change is obtained by means of a so-called adapter spring, which experiences a uniform excursion change per unit of r.p.m. change in the intermediate r.p.m. region. However, at full load this adapter spring must be disabled in order to arrive at the course of the characteristic curve III from that of the characteristic curve V.

In the embodiment of the invention shown in FIG. 3 two spacedly arranged springs 85 and 86, respectively, encircle a rod 67 and are confined for axial movement by a yoke 68, one end of which is secured by a bolt 49 to a lug or setting lever 69 and therethrough to the actuating lever 52 via the shaft 53. The arms 70 of the yoke 68 extend parallel to the axis of rod 67 and possess inwardly extending hooked ends 71. Abutting these ends is a dish-shaped spring support member 73 which includes a perforated collar 74 that is penetrated by the actuating rod 67. At the juncture of the arms 70 there is disposed a further dish-shaped spring support member 75 having a generally similar perforated collar 76. The actuating rod 67 is guided through the collars 73, 75 and its terminus 77 abuts the base 78 of the yoke 68. Adjacent to the end 77 of the rod 67 there is provided an annular groove 79 into which a guard ring 80 is squeezed. The lower dish-shaped spring support member 75 includes a cylindrical recess 81 into which the guard ring 80 is received.

Located between the spring support members 73 and 75, and similarly penetrated by the rod 67, is a third spring support member 83 which, as in the other spring support members, includes an element 84 which includes oppositely disposed seating surfaces arranged to receive springs 85 and 86, respectively. The adapter spring 85 is positioned between the spring support member 73 and the seat provided on support member 83 and the regulator spring 86 is located between the spring support member 83 and the perforated collar 75. In order to assure a sufficient pre-stressing of the regulator spring 86, the spring support member 83 is arranged to thrust against a guard ring 87 that is disposed in an annular groove 88 provided in the actuating rod 67. The spring support member 83 thus has a degree of freedom only in the direction toward the spring collar 75 by reason of the elongated sleeve which has a bore 89. The element 84 of the spring support member 83 includes an integral elongated sleeve 90 which limits the excursion of the adapter spring 85. In addition, the adapter spring 85 is designed and constructed to be stiffer than the regulator spring 86.

During the rise of the r.p.m. in the partial load region, the adapter spring 85 is compressed, so that toward the end of the r.p.m. range, that is to say, shortly prior to the start of the reduction regulation, the spring support members 73 and 83 are brought into abutment. Only subsequent to such abutment of said elements can the regulator spring 86 be compressed during the further rise of the r.p.m. On the other hand, at the full load state, that is when the accelerator pedal is fully depressed, the element 84 is initially pushed toward the spring support member 73. In other words, the adapter spring is disabled and the centrifugal force mechanism of the regulator begins to compress the spring 86 at the r.p.m. magnitude $n_3$, as a result of which the sleeve 28 is displaced in the direction which brings about a diminution of the quantity of fuel injected.

As evident from FIG. 1, the actuating rod 67 is coupled to the regulator lever 41 by means of a head 91 and a spring 92 is interposed between the head 91 and the regulator lever 41. In this view, the regulator is in the starting position, that is, the spring 92 pushes the end of the regulator lever 41 away from the head 91. This results in the sleeve 28 being pushed upward as far as possible, so that the path of the bore 27 in pump piston 8 is now comparatively long, that is, an extra large quantity of fuel is now conveyed to the engine, As soon after starting as the idling r.p.m. magnitude is reached the spring 92 is also compressed. However, the end of the regulator lever 41 is not brought into abutting engagement with the head 91. That only happens when the idle running r.p.m. magnitude is exceeded.

In a further embodiment of this invention which is depicted in FIG. 4, two spacedly arranged spring systems are arranged in tandem and are coupled together by means of the actuating rod 67'. However, in this construction the regulator spring 86' comprises one spring system and the idling spring 92' and the adapter spring 85' comprise the second spring system. Thus it is possible to achieve a simpler spring adjustment that is independent of the regulator spring 86'.

The system which contains the regulator spring 86' is, in principle, constructed like the system depicted in FIG. 3 except for the omission of the spring support member 83 and the adapter spring 85. Spring support members 73' and 75' constrain the regulator spring 86'. In the second spring system, the idling spring 92' is carried within a preforated pot 93 through which extends an actuator rod 67', the upper free end of which is provided with an annular groove that is provided with a ring which supports a retainer for a spring assembly as will now be explained.

The pot includes an annular flange that is received in a recess in lever 41' and an idling spring 92' which encircles rod 67' is interposed between the base of the pot 93 and a flange 94 of a perforated hub 95, the axial elongation of which hub serves as the excursion limit of the idling spring 92'. In a mirror image disposition to this first spring support 94 there is a further spring support 97 which also has a hub shaped interior against which the adapter spring 85' thrusts. The axial elongation 97 serves to limit the excursion of this hub by cooperating with the retainer 98 against which the adapter spring 85' abuts. The second spring support 98 thrusts against a guard ring 99 lying in an annular groove 100 adjacent to the end of the connecting rod 67'. The perforated pot 93 is situated in a bore of the regulator lever 41'. As in the embodiment of FIG. 3, after starting of the engine, the idling spring 92' is compressed first, until the hub 95 butts against the pot base. Subsequent thereto, in the region of partial load, the adapter spring 85' is compressed according to the given r.p.m. magnitude until, at full load, the hub 97 then butts against the spring dish 98. The regulator spring 86' then becomes effective for the r.p.m. reduction at the earliest at the r.p.m. magnitude $n_3$ during the full load state.

Tension springs can also be utilized instead of pressure springs. The decisive characteristic is that the adapter spring is disabled near the end of the partial load region.

The foregoing relates to preferred exemplary embodiments of the invention, it being understood that other embodiments and variants are possible within the spirit and scope of the invention, the latter being defined by the appended claims.

What is claimed is:

1. In an r.p.m. regulator of a fuel injection pump for internal combustion engines, including a fuel supply quantity setting member, a control spring mechanism having a preloaded control spring, a control lever connected to the control spring mechanism and to the fuel supply quantity setting member for actuating said fuel supply quantity setting member, said control lever being pivotably mounted between its connected ends, a setting lever, said control spring mechanism being connected to said setting lever and to said control lever thereby applying the preload of said control spring to said control lever, and an r.p.m.-dependent force applying means engaging said control lever between its ends for applying thereto an r.p.m.-dependent force in opposition to the force exerted by said control spring, a first connecting member connected to said setting lever, a second connecting member connected to said control lever, both said connecting members being part of said control spring mechanism, the improvement comprising:

tandem springs axially aligned between said first and second connecting members and excursion limiting means interposed between at least two of said springs.

2. The r.p.m. regulator as defined in claim 1, wherein said first connecting member comprises a stamped metal bracket having a base portion at one end defining a central stop and a symmetrical pair of stops at its other end, wherein said second connecting member comprises an actuating rod, and wherein at least one of said tandem springs is mounted between said actuating rod and said bracket and coaxially with said actuating rod such that at least one of said tandem springs biases said actuating rod against said central stop.

3. The r.p.m. regulator as defined in claim 2, wherein said actuating rod includes a further safety ring mounted within an annular groove, said safety ring forming a stop means for said excursion limiting means.

4. The r.p.m. regulator as defined in claim 2, wherein the said actuating rod includes a further safety ring mounted in an annular groove, wherein a perforated pot member is supported by said control lever wherein said tandem springs encircle said actuating rod and are disposed between said pot and said further safety ring.

5. The r.p.m. regulator as defined in claim 4, wherein said tandem springs are maintained in relative axial spaced relation by perforated means interposed therebetween.

6. The r.p.m. regulator as defined in claim 5, wherein said perforated means interposed between said tandem springs comprise mirror image members of varying length.

7. The r.p.m. regulator as defined in claim 5, wherein said tandem springs comprise a starting spring and a running spring, respectively.

8. The r.p.m. regulator as defined in claim 6, wherein one of said mirror images is confined wholly within said perforated pot member.

9. The r.p.m. regulator as defined in claim 6, wherein said mirror image members comprise hub means.

10. The r.p.m. regulator as defined in claim 1, wherein said control lever is arranged to support a perforated pot that is associated with at least two of said tandem springs.

11. The r.p.m. regulator as defined in claim 1, wherein said tandem springs are of a different stiffness.

* * * * *